US005196073A

United States Patent [19]

Liljas et al.

[11] Patent Number: 5,196,073

[45] Date of Patent: Mar. 23, 1993

[54] STAINLESS STEEL

[75] Inventors: Mats Liljas, Avesta; Jaroslav Pleva, Hagfors; Peter Stenvall, Avesta, all of Sweden

[73] Assignee: Avesta Aktiebolag, Avesta, Sweden

[21] Appl. No.: 861,445

[22] Filed: Apr. 1, 1992

[51] Int. Cl.[5] ..... C22C 38/44; C22C 38/50

[52] U.S. Cl. ..... 148/326; 148/327

[58] Field of Search ..... 148/326, 327

[56] References Cited

U.S. PATENT DOCUMENTS

| | | | |
|---|---|---|---|
| 3,717,455 | 2/1973 | Hede et al. | 148/326 |
| 3,929,520 | 12/1975 | Hellner et al. | 420/46 |
| 4,353,755 | 10/1982 | Solomon | 148/326 |
| 4,793,875 | 12/1988 | Larson | 148/326 |

*Primary Examiner*—Deborah Yee
*Attorney, Agent, or Firm*—Nixon & Vanderhye

[57] ABSTRACT

A stainless steel having a two-phase structure of austenite and ferrite, the steel consisting essentially of in weight-% not more than 0.03% C, not more than 0.03% N, the total amount of C+N not being more than 0.05%, 1.5-2.5% Si, 0.5-2% Mn, not more than 0.03% P, not more than 0.010% S, 22-26% Cr, 8-11% Ni, 2-3% Mo, 0.35-0.55% Ti, % Cr+3.3×% Mo being at least 29.0, balance iron and impurities, said steel having been subjected to a heat treatment consisting of solution annealing in the temperature range 1100°-1250° C. and water quenching followed by aging in a temperature range 500°-600° C. for at least 30 min, wherein precipitates consisting essentially of $Ni_{16}Ti_6Si_7$, so called G-phase, are precipitated in the form of particles evenly distibuted in the ferrite, said particles typically having a size of 10-50 Å, imparting the material an improved yield srength in the annealed and aged condition, said yield strength amounting to at least 800 MPa in combination with a Charpy V impact strength of at least 25 J, a critical pitting temperature (CPT) higher than about 50° C. in 3% NaCl-solution at 200 mV SCE, and a pitting potential Ep in 0.1N-NaCl-solution, 80° C., of at least about 300 mV SCE.

6 Claims, 1 Drawing Sheet

STAINLESS STEEL

TECHNICAL FIELD

The present invention relates to a stainless steel having a two-phase structure of austenite and ferrite. Because of its good mechanical and corrosion properties the steel of the invention is particularly useful as a material of construction in bar and forging applications such as:

shafts in pumps, propellers, fans;

valves and fittings;

fasteners and bolts in pipe systems, building and construction;

reinforcement in concrete;

rotating parts in centrifugal separators, etc, and;

erosion and corrosion fatigue applications.

BACKGROUND OF THE INVENTION

A feature which usually is aimed at when developing duplex stainless steels is the combination of good corrosion resistance and strength in quenched and annealed condition. For example, this feature was aimed at in the development of the ferritic-austenitic stainless steel which is disclosed in WO 88/02032. In applications, such as propeller and pump shafts, fans and highly loaded components, however, even higher mechanical strength in combination with excellent corrosion properties, particularly a high pitting corrosion resistance, is desirable to improve process efficiency, service life or weight of constructions.

There exist several ways to improve mechanical strength of stainless steels: cold deformation, nitrogen alloying or precipitation hardening (PH). The cold deformation technique has several limitations; particularly that it is useful only for products in rather small cross sections and which shall not be further deformed by bending or the like subsequent to the cold working operation. As far as the method of improving mechanical strength by nitrogen alloying is concerned, it does not give the desired increase in strength for duplex steels as nitrogen favours the softer phase in the structure, the austenite.

BRIEF DESCRIPTION OF THE INVENTION

The present invention makes use of precipitation hardening in order to improve the steel material previously suggested in WO 88/02032 and particularly to provide a stainless steel having increased strength in combination with a high impact strength and good corrosion resistance, particularly a good resistance to pitting corrosion.

This and other objectives may be achieved by a steel consisting essentially of in weight-% not more than 0.03% C, not more than 0.03N, the total amount of C+N not being more than 0.05%, 1.5–2.5% Si, 0.5–2%

Mn, not more than 0.03% P, not more than 0.010% S, 22–26% Cr, 8–11% Ni, 2–3% Mo, 0.35–0.55% Ti, wherein % Cr+3.3×% Mo being at least 29.0, preferably at least 29.5 and most suitably at least 30.0, balance iron and impurities, said steel having been subjected to a heat treatment consisting of solution annealing in the temperature range 1100°–1250° C. and water quenching followed by aging in the temperature range 500°–600° C. for at least 30 min, wherein precipitates consisting essentially of $Ni_{16}Ti_6Si_7$, so called G-phase, are precipitated in the form of particles evenly distributed in the ferritic structure, said particles typically having a size of 10–50 Å, giving the material an improved yield strength in the annealed and aged condition amounting to at least 800 MPa in combination with a Charpy V impact strength of at least 25 J, a critical pitting temperature (CPT) higher than about 50° C. in 3% NaCl-solution, at 200 mV SCE, and a pitting potential Ep in 0.1N-NaCl-solution, 80° C., of at least about 300 mV SCE.

Preferably the steel contains 22–24% Cr (suitably about 23% Cr), 8–10% Ni (suitably about 9% Ni) and 0.35–0.50% Ti.

By the preferred chemical composition of the steel it is possible to achieve a yield strength amounting at least 850 MPa and a critical pitting temperature of at least 60° C. in 3% NaCl-solution at 200 mV SCA in the annealed and aged condition of the steel material.

In order that the toughness is kept at at least the mentioned level, the steel structure should contain at least 15% ductile austenite phase.

Other characteristic features of the steel material of the invention will be disclosed in the following description of a number of experiments.

BRIEF DESCRIPTION OF DRAWINGS

In the following description of performed experiments, reference will be made to the attached drawings, in which.

MATERIAL

Figure 1:
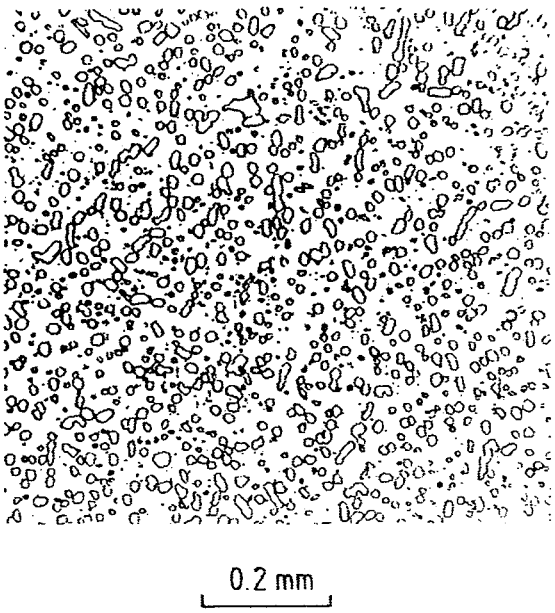
FIG. 1 is an optical micrograph of the ferritic-austenitic structure of a steel material of the invention.

The chemical composition of investigated laboratory heats is detailed in Table 1. The material was produced in a vacuum induction furnace giving 30 kg ingots, which were hot forged into flat bars of 30×60 mm (for steel nr 4, 25×55 mm).

TABLE 1

| | | Compositions of laboratory melts, weight-% | | | | | | | | | | | |
|---|---|---|---|---|---|---|---|---|---|---|---|---|---|
| Steel No. | Heat | C | N | C + N | Si | Mn | P | S | Cr | Ni | Mo | Ti | PRE[1)] |
| 1 | V112 | .013 | .014 | .027 | 1.8 | .96 | .006 | .009 | 20.0 | 7.3 | 2.5 | .31 | 28.4 |
| 2 | V141 | .018 | .008 | .026 | 2.0 | 1.0 | .016 | .006 | 20.2 | 7.5 | 2.5 | .38 | 28.5 |
| 3 | V142 | .016 | .015 | .031 | 1.9 | 1.1 | .016 | .006 | 20.2 | 7.9 | 2.5 | .55 | 28.6 |
| 4 | 2967-2 | .026 | .046 | .072 | 2.0 | .7 | .020 | .004 | 19.8 | 6.5 | 2.5 | .49 | 28.1 |
| 5 | V160 | .02 | .014 | .034 | 1.6 | 1.2 | .015 | .001 | 22.7 | 9.0 | 2.2 | .37 | 30.0 |
| 6 | V161 | .02 | .027 | .047 | 1.9 | 1.2 | .015 | .004 | 22.8 | 9.0 | 2.4 | .49 | 30.7 |
| 7 | V162 | .02 | .020 | .040 | 2.0 | 1.2 | .014 | .001 | 22.5 | 8.8 | 2.4 | .41 | 30.4 |

[1)]PRE = % Cr + 3.3 × % Mo

Samples of the forged material were solution annealed in the temperature range 1100°-1250° C. and water quenched followed by aging at 550° C. for 1-2 h and water cooling.

Optical microscopy was used to investigate the structure of the material on a larger scale. Transmission electron microscopy (TEM) and atom probe field ion microscopy (APFIM) were used to study particles at very high magnifications. APFIM is a microanalytical instrument that combines very high lateral (1 nm) and depth (0.2 nm) resolution with detection limit below 0.01 at-% for all elements. Two laboratory melts steel No. 4/heat 2967-2 and steel No. 5/heat V160 were chosen for TEM and APFIM study. Both materials received a thermal treatment at 1100° C. for 30 min with subsequent $H_2O$ quenching. Steel No. 4 was aged at 550° C. for 2 h, and steel No. 5 was aged at 550° C. for 1 h.

CORROSION

Two different methods of measuring the resistance of the material to pitting corrosion have been used: critical pitting temperature (CPT) measurement, and measurement of the pitting potential, Ep.

CPT has been measured using the automated instrument SANTRON EMS in neutral 3% NaCl-solution, air saturated, at a constant potential of +200 mV SCE (Saturated Calomel Electrode). The initial temperature was increased in steps of 3° C., until increasing current indicated the initiation of corrosion attack. CPT is defined as the highest temperature obtainable before corrosion begins, i.e. when steady increase of the current is observed.

The critical pitting potential, Ep, was measured in 0.1N-NaCl at 80° C. A potentiodynamic scan of 3.3 mV/min was started at −300 mV SCE.

RESULTS AND DISCUSSION

Material structure

Figure 2:
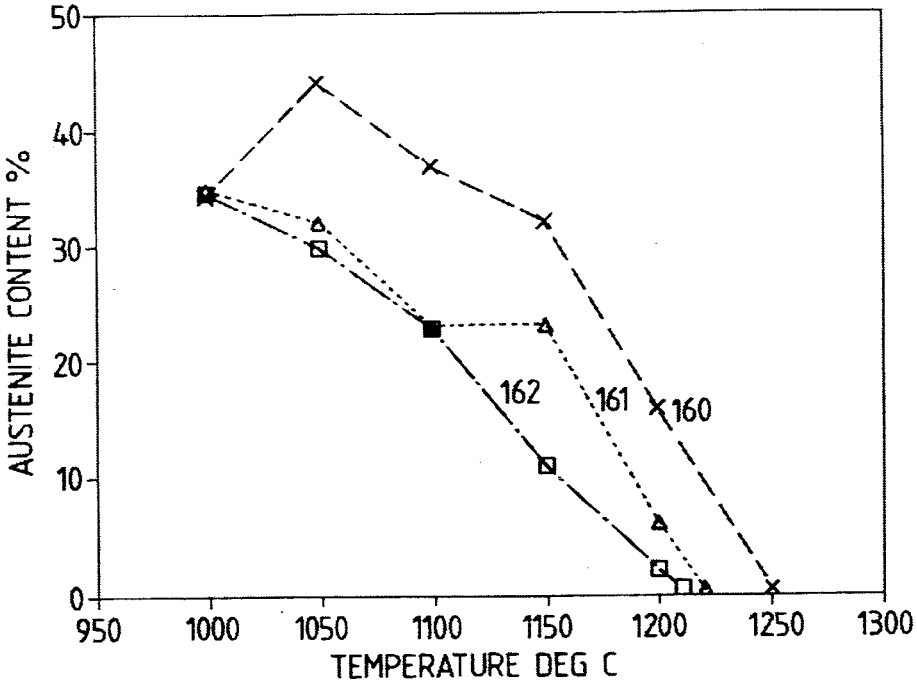
FIG. 2 is a chart showing the austenite content versus the annealing temperature for three steel compositions of the invention.

A typical ferritic-austenitic structure of the heat treated steel of the invention, represented by steel No. 5, is shown in FIG. 1. The austenitic phase (light) is evenly distributed as islands in the ferrite matrix (dark). The material shown in FIG. 1, steel No. 5, was annealed at 1150° C. for 30 min and quenched in water. As expected the amount of austenite content in the material decreased with increasing annealing temperature. For steel No. 5 the material became fully ferritic at 1250° C. This temperature was slightly lower (about 1200° C.) for steel Nos. 6 and 7, FIG. 2.

Figure 3:
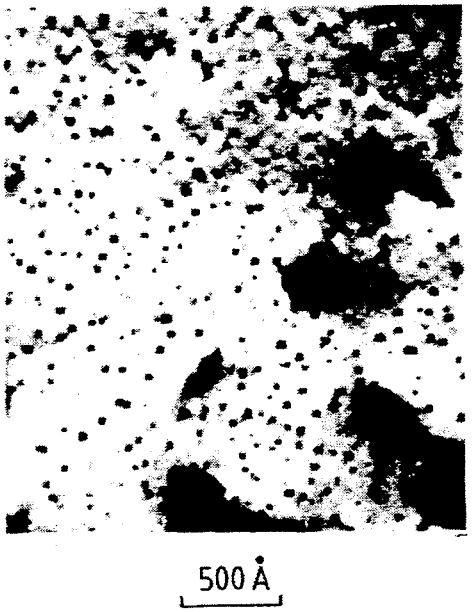
FIG. 3 is a TEM bright field micrograph showing dense distribution of small G-phase precipitates in the ferrite matrix of a steel material of the invention.

TEM investigation of one of the steel materials of the invention (steel No. 5 after annealing at 1100° C. and aging at 550° C.) revealed the existence of small precipitates densely distributed in the ferrite matrix, FIG. 3. The majority of the observed precipitates had sizes in the range 10-50 Å.

The APFIM analysis of the precipitates in the material showed that they were of $Ni_{16}Ti_6Si_7$ type which is known as G-phase, with Ni and Ti as major metallic elements. Other elements, such as Mo, Mn, Al and P were also incorporated to a minor degree in the silicides. The composition profiles of investigated precipitates showed that P was concentrated to the interphase between the matrix and the precipitates rather than incorporated into the precipitates themselves.

The obtained results show that the precipitation of the G-phase at 550° C. is very fast. In the preamble to this specification it is mentioned that cold deformation is also a way to improve mechanical strength of stainless steels. However, it appears that cold deformation and precipitation hardening by means of precipitated G-phase can not be combined in order to achieve extreme strength and other desired properties. Experiments, which are not reported in detail here, namely show, that aging of the steel having a composition according to the present invention did not add any strength to the increase of strength achieved already by the cold deformation. It is assumed that the G-phase precipitates through the combined cold working and aging will grow well beyond the range 10-50 Å. This also indicates that the smallness of the precipitates, 10-50 Å, is significant for the achievement of the increased strength in combination with the other valueable properties of the material of the invention.

The mechanical properties of the different heat treatments are summerized in the middle part of Table 2. Best balance between strength and toughness was obtained for steel Nos. 5, 6 and 7 and particularly for steel No. 5. Generally an increase of the solution annealing temperature by 50° C. resulted in an increase of the strength and decrease of the toughness of the material, which can be explained by the increase of the ferrite content in the material with increasing annealing temperature. On the other hand, the increase of the aging time (in range 1 h to 2 h) had little influence of the yield strength of the material. This result is in a good agreement with the theory that the improved strength of the material of the invention originates from the precipitation of the observed silicides (G-phase). According to TEM and APFIM analysis the precipitation of the silicides at 550° C. is a very fast process so that the amount, size and composition of the precipitates is not essentially influenced by the changes in the aging time from 1 to 2 h.

TABLE 2

| Steel | Heat Treatment | | Mechanical Properties | | | | | | Resistance to Pitting Corrosion | |
|---|---|---|---|---|---|---|---|---|---|---|
| | | | | | | | | | CPT | Ep in |
| No. | Annealing | Ageing | $R_{p0.2}$ MPa | Rm MPa | A5 % | Z % | Charpy V J | Hardness HRC | 3% NaCl 200 mV SCE | 0.1 N—NaCl, 80° C. mV SCE |
| 1 | 1100° C./1 h/$H_2O$ | 550° C./1 h/$H_2O$ | 747 | 957 | 22 | | 28 | | 25 | 108 |
| 1 | 1100° C./1 h/$H_2O$ | 550° C./2 h/$H_2O$ | 742 | 940 | 23 | | 29 | | 25 | 105 |
| 2 | 1100° C./30 min/$H_2O$ | 550° C./1 h/$H_2O$ | 640 | 868 | 24 | 63 | 37 | 31.6 | 30 | 238 |
| 3 | 1100° C./30 min/$H_2O$ | 550° C./1 h/$H_2O$ | 727 | 935 | 24 | 57 | 14 | 34.8 | 23 | 203 |
| 2 | 1100° C./30 min/$H_2O$ | 550° C./2 h/$H_2O$ | 804 | 953 | 23 | 63 | 7 | | | |
| 3 | 1100° C./30 min/$H_2O$ | 550° C./2 h/$H_2O$ | 859 | 1022 | 25 | 61 | 10 | | | |
| 2 | 1150° C./30 min/$H_2O$ | 550° C./1 h/$H_2O$ | 612 | 873 | 27 | 60 | 29 | 26.5 | | |
| 3 | 1150° C./30 min/$H_2O$ | 550° C./1 h/$H_2O$ | 746 | 952 | 22 | 55 | 12 | 26.5 | | |
| 2 | 1150° C./30 min/$H_2O$ | 550° C./2 h/$H_2O$ | 782 | 945 | 22 | 51 | 7 | | | |
| 3 | 1150° C./30 min/$H_2O$ | 550° C./2 h/$H_2O$ | 1008 | 1140 | 17 | 50 | 8 | | | |
| 4[1)] | 1100° C./1 h/$H_2O$ | 550° C./2 h/$H_2O$ | 756 | 925 | 22 | 46 | | | | |
| 4[1)] | 1100° C./1 h/$H_2O$ | 600° C./2 h/$H_2O$ | 763 | 935 | 16 | 38 | | | | |

TABLE 2-continued

| Steel No. | Heat Treatment Annealing | Heat Treatment Ageing | Mechanical Properties $R_{p0.2}$ MPa | Rm MPa | A5 % | Z % | Charpy V J | Hardness HRC | Resistance to Pitting Corrosion CPT 3% NaCl 200 mV SCE | Ep in 0.1 N—NaCl, 80° C. mV SCE |
|---|---|---|---|---|---|---|---|---|---|---|
| 5 | 1100° C./30 min/$H_2O$ | 550° C./1 h/$H_2O$ | 850 | 971 | 25 | 68 | 59 | 33 | | |
| 6 | 1100° C./30 min/$H_2O$ | 550° C./1 h/$H_2O$ | 938 | 1032 | 24 | 58 | 26 | 38 | | |
| 7 | 1100° C./30 min/$H_2O$ | 550° C./1 h/$h_2O$ | 988 | 1105 | 20 | 62 | 25 | 37 | | |
| 5 | 1100° C./30 min/$H_2O$ | 550° C./2 h/$H_2O$ | 874 | 990 | 24 | 66 | 57 | | 71 | 373 |
| 6 | 1100° C./30 min/$H_2O$ | 550° C./2 h/$H_2O$ | 1034 | 1134 | 21 | 56 | 24 | | 73 | 409 |
| 7 | 1100° X/30 min/$H_2O$ | 550° C./2 h/$H_2O$ | 1006 | 1100 | 22 | 54 | 24 | | 90 | |
| 5 | 1150° C./30 min/$h_2O$ | 550° C./1 h/$H_2O$ | 940 | 1038 | 22 | 63 | 43 | 33 | | |
| 6 | 1150° C./30 min/$H_2O$ | 550° C./1 h/$H_2O$ | 993 | 1112 | 20 | 50 | 19 | 37 | | |
| 7 | 1150° C./30 min/$H_2O$ | 550° C./1 h/$H_2O$ | 1063 | 1166 | 19 | 47 | 25 | 39 | | |
| 5 | 1150° C./30 min/$H_2O$ | 530° C./2 h/$H_2O$ | 957 | 1050 | 20 | 59 | 41 | 34 | 68 | 354 |
| 6 | 1150° C./30 min/$H_2O$ | 530° C./2 h/$H_2O$ | 1053 | 1056 | 19 | 45 | 17 | 39 | 73 | |
| 7 | 1150° C./30 min/$H_2O$ | 530° C./2 h/$H_2O$ | 1007 | 1153 | 20 | 52 | 21 | 39 | 61 | |
| | | | | Reference materials: | | | AISI 304 | | 30–40 | |
| | | | | | | | AISI 316 | | 40 | 200 |

Corrosion resistance

The CPT test showed that the steels of the invention in the annealed and aged condition possess clearly better pitting resistance than steel Nos. 1–3 which have been treated in the same way and have a similar but not exactly the same alloy composition as the steel of the invention. Also the obtained Ep values were higher than those obtained for steel Nos 1–3, which indicate that the modification of the alloy composition as compared to steel Nos 1–3 has a significant importance for the improved corrosion resistance in combination with the simultaneous improvement of the mechanical properties. It is also noted that the steels of the invention possess clearly better pitting resistance than conventional steels AISI 304 and 316.

A reason why the steel of the invention achieves an improved resistance to pitting corrosion in combination with an improved strength is believed to be due to the precipitation of the $Ni_{16}Ti_6Si_7$ phase and that th majority of the precipitates has a size in the range 10–50 Å. This phase contains only minor amount of chromium and molybdenum and exerts therefore little adverse effect on the pitting corrosion resistance.

Because of its good mechanical and corrosion properties the material therefore should be an interesting material of construction in bar and forging applications such as:

shafts in pumps, propellers, fans;

valves and fittings;

fasteners and bolts in pipe systems, building and construction;

reinforcement in concrete;

rotating parts in centrifugal separators etc; and erosion and corrosion fatigue applications.

We claim:

1. A stainless steel having a two-phase structure of austenite and ferrite, the steel consisting essentially of in weight-% not more than 0.03% C, not more than 0.03% N, the total amount of C+N not being more than 0.05%, 1.5–2.5% Si, 0.5–2% Mn, not more than 0.03% P, not more than 0.010% S, 22–26% Cr, 8–11% Ni, 2–3% Mo, 0.35–0.55% Ti, % Cr+3.3×% Mo being at least 29.0, balance iron and impurities, said steel having been subjected to a heat treatment consisting of solution annealing in the temperature range 1100°–1250° C. and water quenching followed by aging in a temperature range 500°–600° C. for at least 30 min, wherein precipitated consisting essentially of $Ni_{16}Ti_6Si_7$, so called G-phase, are precipitated in the form of particles evenly distibuted in the ferrite, said particles typically having a size of 10–50 Å, imparting the material an improved yield strength in the annealed and aged condition, said yield strength amounting to at least 800 MPa in combination with a Charpy V impact strength of at least 25 J, a critical pitting temperature (CPT) higher than about 50° C. in 3% NaCl-solution at 200 mV SCE, and a pitting potential Ep in 0.1N-NaCl-solution, 80° C., of at least about 300 mV SCE.

2. A stainless steel according to claim 1, wherein it contains 22–24% Cr, 8–10% Ni and 0.35–0.50% Ti.

3. A stainless steel according to claim 2, wherein it contains about 23% Cr and about 9% Ni.

4. A stainless steel according to claim 1, wherein % Cr+3.3×% Mo is at least 29.5.

5. A stainless steel according to claim 4, wherein % Cr+3.3×% Mo is at least 30.0.

6. A stainless steel according to claim 1, wherein the yield strength is at least 850 MPa, and the critical pitting temperature is at least 60° C. in 3% NaCl-solution at 200 mV SCE in the annealed and aged condition of the steel material.

* * * * *